US007926135B1

(12) United States Patent
Leach

(10) Patent No.: US 7,926,135 B1
(45) Date of Patent: Apr. 19, 2011

(54) BABY BATH SUPPORT PILLOW

(76) Inventor: Jamie S. Leach, Ada, OK (US)

( * ) Notice: Subject to any disclaimer, the term of this patent is extended or adjusted under 35 U.S.C. 154(b) by 0 days.

(21) Appl. No.: 12/264,487

(22) Filed: Nov. 4, 2008

(51) Int. Cl.
*B68G 5/00* (2006.01)

(52) U.S. Cl. ..... 5/655; 5/652; 5/653; 441/130

(58) Field of Classification Search ..... 5/652, 653, 5/655; 441/43, 129–132
See application file for complete search history.

(56) References Cited

U.S. PATENT DOCUMENTS

| | | | | | |
|---|---|---|---|---|---|
| 1,465,790 | A | * | 8/1923 | Ranlett | 441/132 |
| 1,562,276 | A | * | 11/1925 | Assenzio | 441/132 |
| 1,769,722 | A | | 7/1930 | Sutton | |
| 2,075,374 | A | * | 3/1937 | Tucker | 441/131 |
| 2,207,025 | A | * | 7/1940 | Rison | 441/131 |
| 2,724,843 | A | * | 11/1955 | Kimball | 441/131 |
| 3,583,765 | A | | 6/1971 | Wallis | |
| 3,902,456 | A | | 9/1975 | David | |
| 4,179,158 | A | | 12/1979 | Flaum et al. | |
| 4,434,513 | A | | 3/1984 | Welch | |
| 4,592,589 | A | | 6/1986 | Hellwig | |
| 4,799,700 | A | * | 1/1989 | Knoedler et al. | 280/87.051 |
| 4,834,459 | A | | 5/1989 | Leach | |
| 4,836,605 | A | | 6/1989 | Greenwood et al. | |
| 4,861,109 | A | | 8/1989 | Leach | |
| D309,018 | S | | 7/1990 | Leach | |
| 4,938,722 | A | * | 7/1990 | Rizley | 440/6 |
| 4,980,937 | A | | 1/1991 | Mason et al. | |
| 5,103,514 | A | | 4/1992 | Leach | |
| D339,923 | S | | 10/1993 | Clarke | |
| 5,325,818 | A | | 7/1994 | Leach | |
| 5,455,973 | A | | 10/1995 | Brumfield et al. | |
| 5,520,561 | A | * | 5/1996 | Langenohl | 441/129 |
| 5,546,620 | A | | 8/1996 | Matthews | |
| 5,628,658 | A | * | 5/1997 | Clifford | 441/130 |
| 5,688,153 | A | * | 11/1997 | Yeung | 441/132 |
| 5,813,066 | A | | 9/1998 | Gebhard et al. | |
| 5,839,138 | A | | 11/1998 | Weidman et al. | |
| 6,079,067 | A | | 6/2000 | Becker et al. | |
| 6,126,504 | A | * | 10/2000 | Day | 441/131 |
| 6,142,839 | A | * | 11/2000 | Wilcox | 440/6 |

(Continued)

OTHER PUBLICATIONS

The "Tuckie Duckie" product shown in the webpage (Exhibit 5) from http://www.leachco.com published by Leachco, Inc. (Ada, OK, USA) on May 23, 2009, was in public use and/or on sale at least since about Jun. 2005.

(Continued)

*Primary Examiner* — Michael Trettel
*Assistant Examiner* — William Kelleher
(74) *Attorney, Agent, or Firm* — Mary M. Lee

(57) ABSTRACT

A pillow for supporting a baby during bath time. The pillow comprises a compressible, shape-sustaining, C-shaped bolster with a center well sized to surround and "hug" the torso of a baby or toddler. A collapsible seat is attached to the bolster. The seat bottom is supported by a sidewall that is continuous with the inner sidewall of the bolster. In a first, extended position, the seat bottom is positioned a distance below the bottom of the bolster. This configuration is ideal for a baby or toddler in a seated position, allowing the child to sit upright inside the pillow's well. The seat may be configured in a second, collapsed position with the seat bottom forming a sling that extends across the well of the bolster. By flipping the pillow over, this configuration is ideal for supporting a small or newborn infant in a reclining position for bathing.

14 Claims, 4 Drawing Sheets

U.S. PATENT DOCUMENTS

| | | | | |
|---|---|---|---|---|
| 6,267,635 | B1 * | 7/2001 | Blair | 441/130 |
| 6,276,979 | B1 * | 8/2001 | Saltel et al. | 441/132 |
| 6,343,727 | B1 | 2/2002 | Leach | |
| 6,354,665 | B1 | 3/2002 | Ross | |
| 6,363,558 | B1 | 4/2002 | Dunne | |
| 6,427,251 | B1 | 8/2002 | Leach | |
| 6,499,164 | B1 | 12/2002 | Leach | |
| 6,539,567 | B1 | 4/2003 | Bae | |
| 6,553,590 | B1 | 4/2003 | Leach | |
| 6,601,252 | B1 | 8/2003 | Leach | |
| 6,751,817 | B1 | 6/2004 | Leach | |
| 6,760,934 | B1 | 7/2004 | Leach | |
| 6,763,539 | B1 | 7/2004 | Bartley et al. | |
| 6,857,150 | B2 | 2/2005 | Matthews Brown et al. | |
| 6,929,521 | B2 * | 8/2005 | Howerton | 441/132 |
| 7,000,275 | B2 | 2/2006 | Matthews Brown et al. | |
| 7,010,821 | B1 | 3/2006 | Leach | |
| 7,017,212 | B2 | 3/2006 | Matthews Brown | |
| 7,114,206 | B2 | 10/2006 | Leach | |
| 7,127,760 | B2 | 10/2006 | Bartley et al. | |
| 7,311,357 | B2 | 12/2007 | Gold et al. | |
| 7,353,552 | B2 | 4/2008 | Leach | |
| 7,500,278 | B2 | 3/2009 | Leach | |
| 7,513,001 | B1 | 4/2009 | Leach | |
| 2002/0029422 | A1 | 3/2002 | Matthews | |
| 2004/0038603 | A1 * | 2/2004 | Gaspar | 441/130 |
| 2005/0210591 | A1 * | 9/2005 | Mead et al. | 5/639 |
| 2005/0278864 | A1 | 12/2005 | Leach | |
| 2006/0236461 | A1 | 10/2006 | Ryan | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0204402 | A1 | 9/2007 | Harris et al. | |
| 2007/0277321 | A1 | 12/2007 | Leach | |

OTHER PUBLICATIONS

The "Bath 'N Bumper" product shown in the webpage (Exhibit 2) from http://www.leachco.com published by Leachco, Inc. (Ada, OK, USA) on Jan. 28, 2008,was in public use and/or on sale at least since about Aug. 1999.

The "Bather Go Round" product shown in the webpage (Exhibit 1) from http://www.leachco.com published by Leachco, Inc. (Ada, OK, USA) on Jun. 25, 2009, was in public use and/or on sale at least since about Aug. 1991.

The "Safer Bather" product shown in the webpage (Exhibit 3) from http://www.leachco.com published by Leachco, Inc. (Ada, OK, USA) on Jun. 25, 2009, was in public use and/or on sale at least since about Jul. 1994.

The "Safer Bather II" product shown in the catalog page (Exhibit 4) from the 2006 Leachco product catalog published by Leachco, Inc. (Ada, OK, USA) in 2006, was in public use and/or on sale at least since about Nov. 1996.

The "Cuddle-U" product shown in the webpage (Exhibit 6) from http://www.leachco.com published by Leachco, Inc. (Ada, OK, USA) on Jul. 29, 2008, was in public use and/or on sale at least since about May 2003.

The "Boppy" product shown in the webpage (Exhibit 7) from http://www.target.com published by Target Corporation (Minneapolis MN, USA) on Jun. 25, 2009, was in public use and/or on sale at least prior to the filed of the present application, that is, at least prior to Nov. 4, 2008.

* cited by examiner

BABY BATH SUPPORT PILLOW

FIELD OF THE INVENTION

The present invention relates generally to pillows and particularly to support pillows for infants and toddlers for use in the bath tub.

BACKGROUND OF THE INVENTION

Bath time is more than just a hygienic necessity. It is also an opportunity for bonding and play. Nevertheless, bathing an infant can be a physical challenge. A happily wiggling infant sitting naked in tub of water can be slippery to hold safely while at the same time manipulating soap and a washcloth. Various bath cushions are available for making bath time easier by providing some additional structure for positioning the baby. However, there remains a need for a bath pillow that is usable with infants of various sizes and ages, while still providing support for a baby in an adult sized bathtub.

DETAILED DESCRIPTION OF THE PREFERRED EMBODIMENTS

Figure 1:
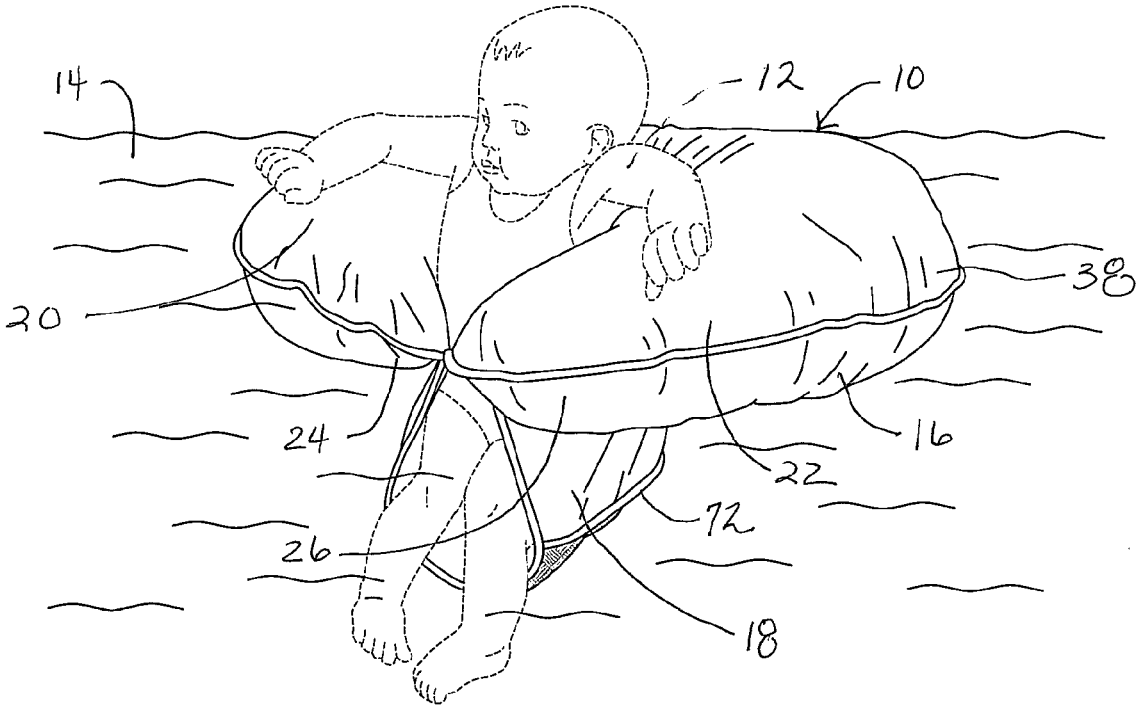
FIG. 1 is a perspective view of a baby bath pillow made in accordance with the present invention. An infant, shown in broken lines, is seated in the center of the pillow.

Turning now to the drawings in general and to FIGS. 1-5 in particular, there is shown therein a pillow made in accordance with a preferred embodiment of the present invention and designated generally by the reference numeral 10. The pillow 10 is designed to support a baby 12, shown in broken lines in FIG. 1, while the baby is in an adult sized bath tub or other body of water 14 (FIG. 1 only). As used herein, "baby" includes infants and toddlers.

Figure 3:
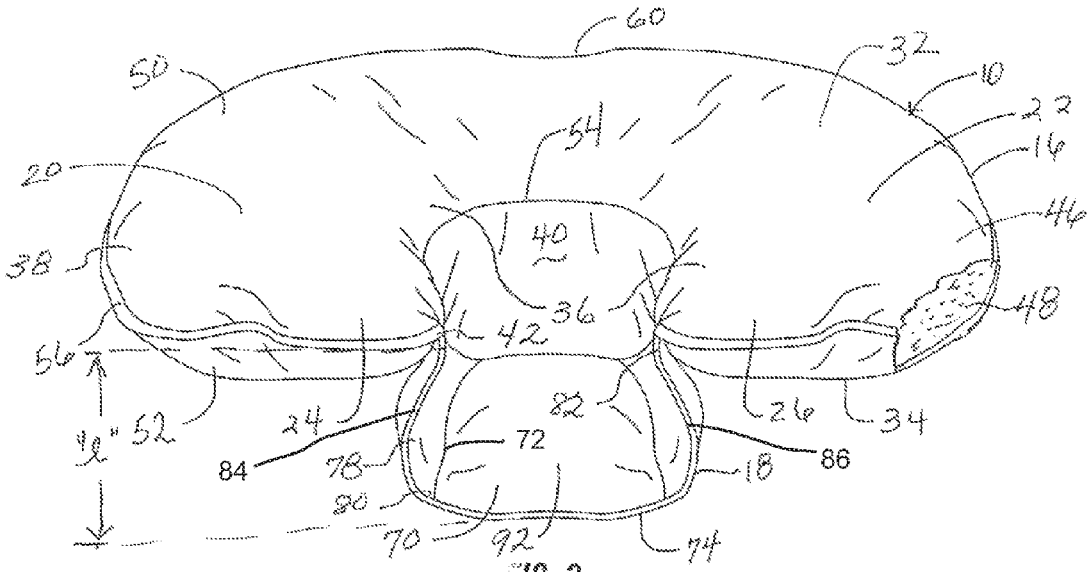
FIG. 3 is a front elevational view of the bath pillow of the present invention in a first position.
Figure 5:
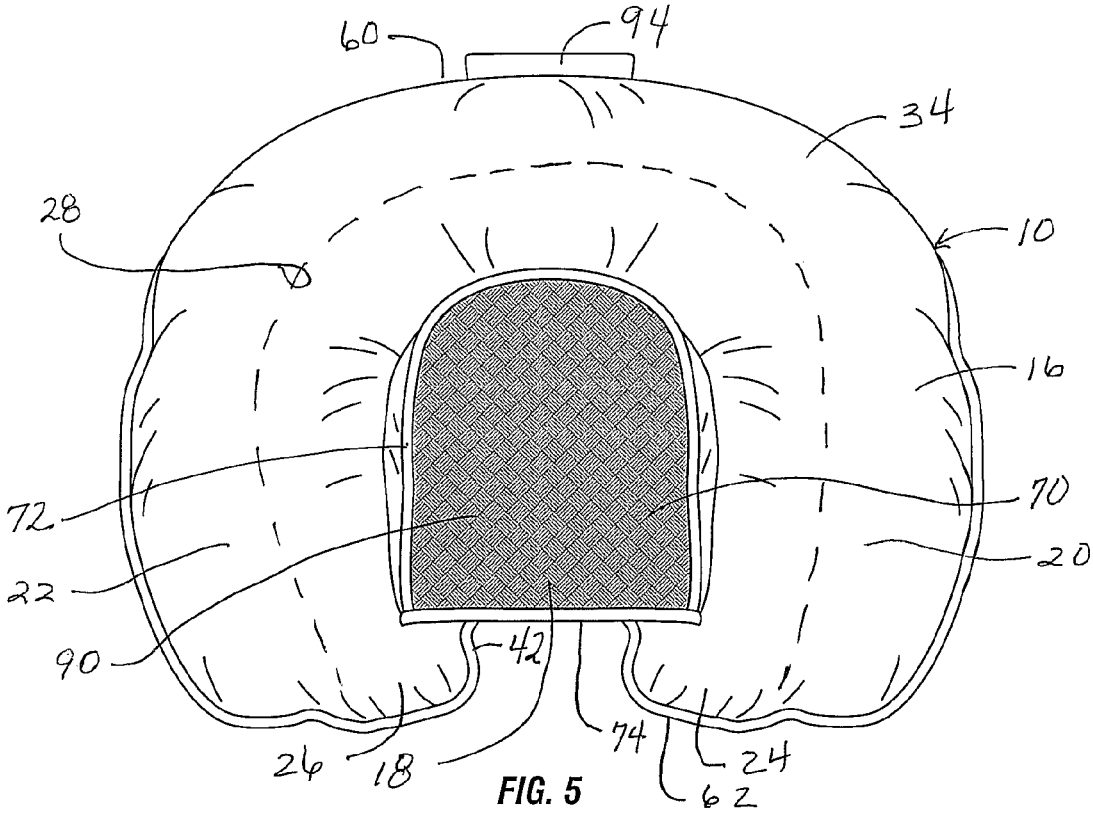
FIG. 5 is a bottom plan view bath pillow shown in FIG. 3.

The bath pillow 10 generally comprises a bolster 16 and a compressible or collapsible seat 18. As best seen in FIGS. 3 and 5, the bolster 16 is compressible and shape-sustaining. That is, the bolster 16 is formed of compressible, resilient material so that it provides good cushioning and yet returns to its original shape or resting position after being compressed or deformed. As used herein, "resting position" refers to the position and shape the bolster 16 naturally assumes when no tension or pressure is exerted on any part of it.

The bolster 16 is generally U-shaped, horseshoe-shaped, or C-shaped, having a pair of opposing cantilevered arms 20 and 22 with opposing free ends 24 and 26 and defining at least a 180 degree curve. More preferably, as indicated by the broken line designated by reference numeral 28 in FIG. 5, the C-shaped bolster forms a curve that is greater than 180 degrees. The bolster 16 has a top or first surface 32 and an opposite bottom or second surface 34. Connecting the first and second surfaces 32 and 34 are an inner sidewall 36 (FIG. 3) and an outer sidewall 38. The inner sidewall 36 defines a central opening or well 40, and the two free ends 24 and 26 define a front opening 42. The well 40 is sized to at least partially encircle the baby's torso.

As seen in FIG. 3, the bolster 16 preferably is formed by a fabric enclosure 46 filled with a loose filler material 48. The enclosure 46 may be made in many ways. Preferably, the enclosure 46 if formed of first and second fabric panels 50 and 52 (FIG. 2) joined by seams 54 and 56 (FIG. 3) circumscribing the inner and outer sidewalls 36 and 38, respectively. As the drawings herein suggest, the first and second panels 50 and 52 of preferably are identical so that the bolster 16 can be flipped from side to side, for a reason to be explained later. It will now also be apparent that the term "sidewall" as used herein does not denote a sidewall with a definite upper and lower borders or edges, but rather indicates the generally vertical, albeit curved, inner and outer sides of the bolster 16.

The fabric of the enclosure 46 may be any suitable fabric, including but not limited to waterproof nylon, flannel, or elastic fabrics, such as spandex or cotton-spandex blends. However, presently an open weave material of 100% polyester is preferred, as this type of material holds up after repeated exposure to water. In most instances, the fabric of the enclosure 46 will be permeable to water. As used herein, "permeable to water" or "water permeable" denotes a fabric that will allow water to pass through it readily so that when the pillow is placed in a body water 14 (FIG. 1), water will fill the bolster 16 making it heavy and less likely to move about in the tub.

A preferred filler material 48 is polyester fiberfill. Other suitable fillers include down feathers, memory foam, and polystyrene pellets. When the filler material 48 is polyester fiberfill or "polyfill," the bolster 16 will be buoyant and will float unless all the air in the enclosure 36 is replaced with water. When the bolster 16 is water-logged, the pillow 10 will become heavy and settle in the water, which causes it to resist moving about unexpectedly in the tub. When the filler 38 is polystyrene beads, the bolster 16 is more buoyant and this construction may be preferred for older babies that are larger and heavier. In this embodiment, the bolster 16 will continue to float, but the baby's weight will hold the pillow 10 in place.

While the shape of the pillow 10 may vary, the preferred shape is curved and symmetrical, the bolster taking a horseshoe shape and the well 40 being teardrop shaped. However, the pillow 10 may be angular or take an irregular or asymmetric shape. Although in the preferred embodiment, the inner and the outer sidewalls 36 and 38 have generally the same shape, the shape of the well 40 may be different from the shape of the outer periphery of the pillow 10. For example, the well 40 could be generally circular while the outer sidewall 38 forms a square. Similarly, though the bolster 16 in the preferred embodiment tapers gradually from the thicker back or center portion 60 to the thinner front 62 (FIGS. 5& 7), the bolster could have a constant cross-sectional shape (top to bottom dimension).

While the dimension of the pillow 10 may vary, the central well 40 preferably is sized to receive the baby 12 in a sitting position as shown in FIG. 1. The width of the well 40 preferably is between about 3 inches to about 6 inches, and more preferably is about 4 inches. The length (front to back) of the well 40 preferably is between about 6 inches to about 12 inches, and more preferably is about 8 inches.

The height, length, and width of the bolster 16 may be the same or different, depending on the desired cross-sectional shape of the bolster. In the illustrated embodiment, the height at the back 60 of the bolster 16 is about 7 inches tapering to about 4-5 inches at the front 62, the width is about 17-18 inches, and the length (front to back) is about 17-18 inches.

With continuing references to FIGS. 1-5, the seat 18 will be described. The seat 18 preferably comprises a flexible and water-permeable seat bottom 70 with a perimeter 72 including a front edge 74. Extending upwardly on three sides of the seat bottom 70 is a flexible seat sidewall 78 having a bottom edge 80 and a top edge 82 (FIG. 3) and first and second front edges 84 and 86. The bottom edge 82 is attached to the perimeter 72 of the seat bottom 70, and the top edge 82 is attached to the bolster 16. Preferably, the top edge 82 is attached in the inner seam 54 (FIG. 3), but the location of attachment may vary. Most preferably, the seat sidewall is formed of a solid panel of fabric forming a generally C-shaped sidewall.

When thus constructed, the seat 18 is positionable in the first or extended position shown in FIGS. 1-5. In this position, the sidewall 78 extends downwardly, that is, from its point of attachment at the seam 54 downwardly, away from or past the second or bottom surface 34 of the bolster 16, as viewed in FIGS. 1-5. In this position, the first and second front edges 84 and 86 of the seat sidewall 78 along with the front edge 74 of the seat bottom 70 form an open front 88 in the seat 18 that is continuous with the front opening 42 in the well 40 of the bolster 16. Additionally, in this position, the seat sidewall 78 is continuous with the inner sidewall 36 of the bolster 16. This first position is ideal for larger, older babies, such as those that are about 6 months and older.

Figure 2:
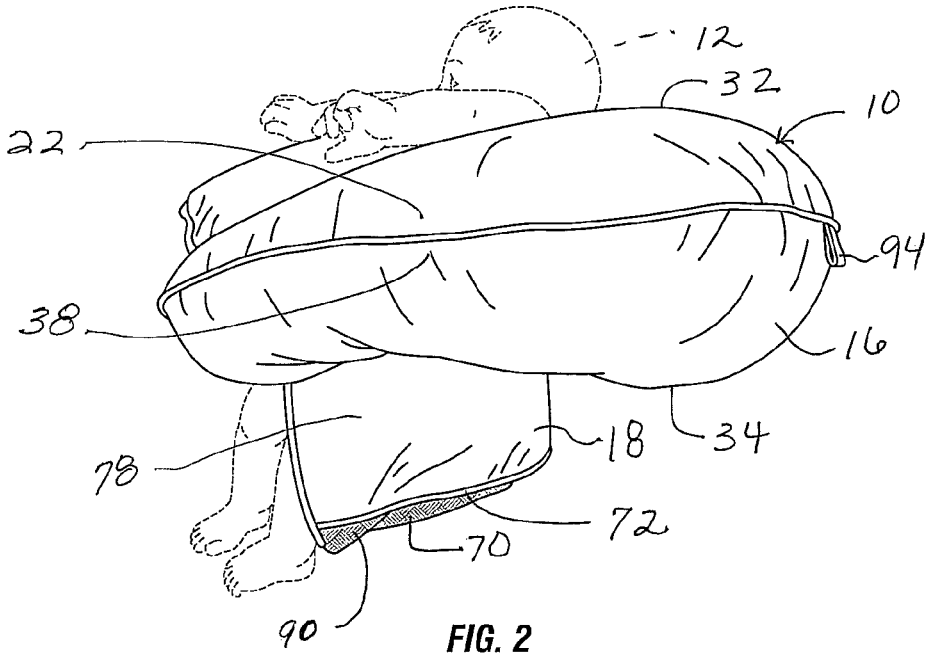
FIG. 2 is a side elevational view of the bath pillow and baby shown in FIG. 1.
Figure 4:
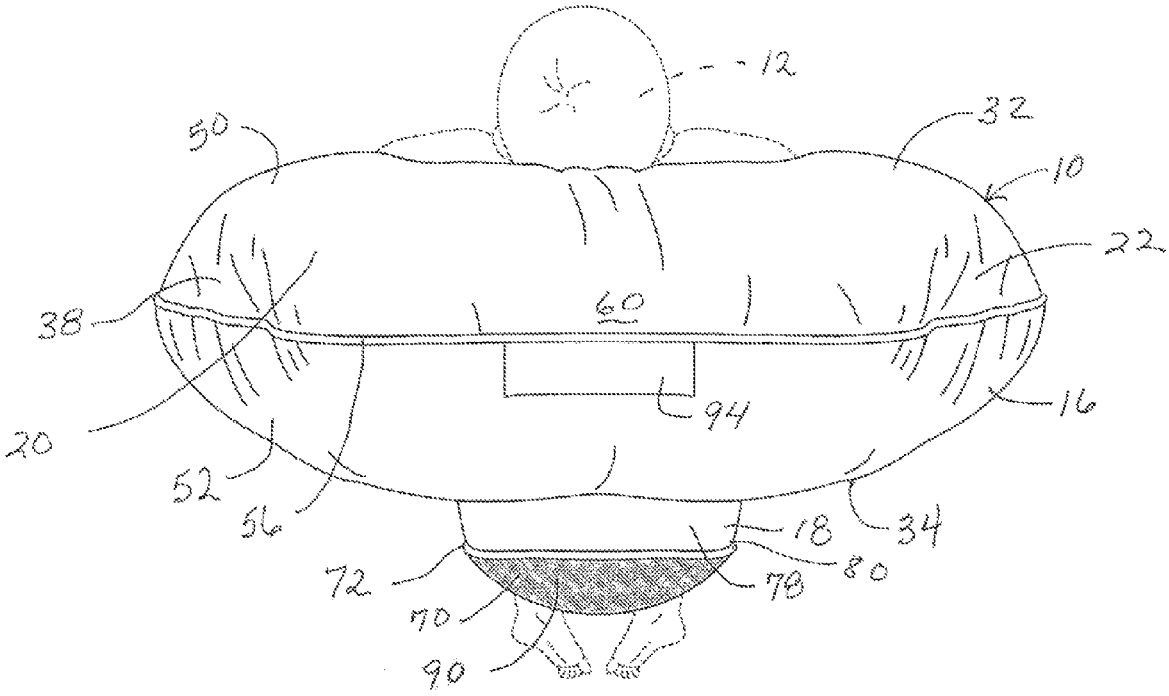
FIG. 4 is a rear elevational view of the pillow and baby shown in FIG. 1.

The distance between the bottom edge 80 and the top edge 82 of the sidewall 78 defines a seat sidewall length "l" that is sufficient so that, when the seat 18 is fully extended, as shown in FIG. 3, in the first direction—downward as seen in FIG. 3—the seat bottom 70 is positioned a distance below the second or bottom surface 34 of the bolster 16, as best seen in FIGS. 1, 2, & 4. Now it will be appreciated that, when a baby 12 is seated in the seat 18, the baby's weight on the seat bottom 78 will pull downward on the arms 20 and 22 of the bolster 16 thereby causing the free ends 24 and 26 of the arms to pull inward towards each other "hugging" the baby's chest or torso to help keep the baby upright in the pillow 10. This hugging effect is illustrated in FIG. 1.

In the embodiment shown, the first or underneath surface 90 of the seat bottom 70 is covered with a non-slip or non-skid material. This allows the bottom 90 of the seat 70 to stick or cling to the bottom of the tub when a baby is seated in it. In the embodiment shown, the non-slip material is provided on only the underneath side 90 of the seat bottom 70. Alternately, the second or top side 92 of the seat bottom 70 could be provided with non-slip material. Still further, both sides 90 and 92 could be provided with non-slip material.

The seat bottom 70 and sidewall 78 may be made of the same water permeable woven fabric as the bolster 16. Alternately, the seat bottom 70 may be made of a single layer of an open weave or plastic mesh. These and other alternatives will be readily apparent.

It will be noted that direction terms, such as "upward" and "downward," as used herein are not limiting but rather are used merely for descriptive purposes and refer to the position of the pillow 10 as shown in the views depicted in the drawings. For example, referring to FIG. 3, the position of the seat 18 could be reversed and pushed upwardly, and the pillow 10 flipped over, thereby providing an identical configuration, but with the non-slip material on the inside surface of the seat bottom 70.

Figure 6:
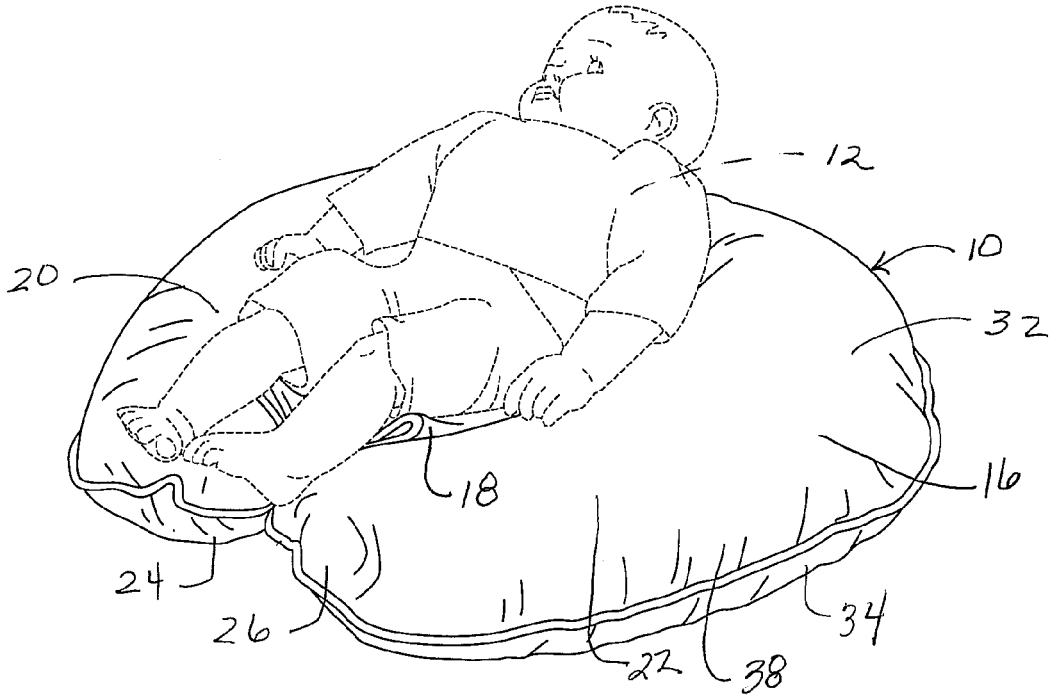
FIG. 6 is a perspective view of the bath pillow in the second or collapsed position. A newborn infant, shown in broken lines, is reclining across the collapsed seat.
Figure 7:
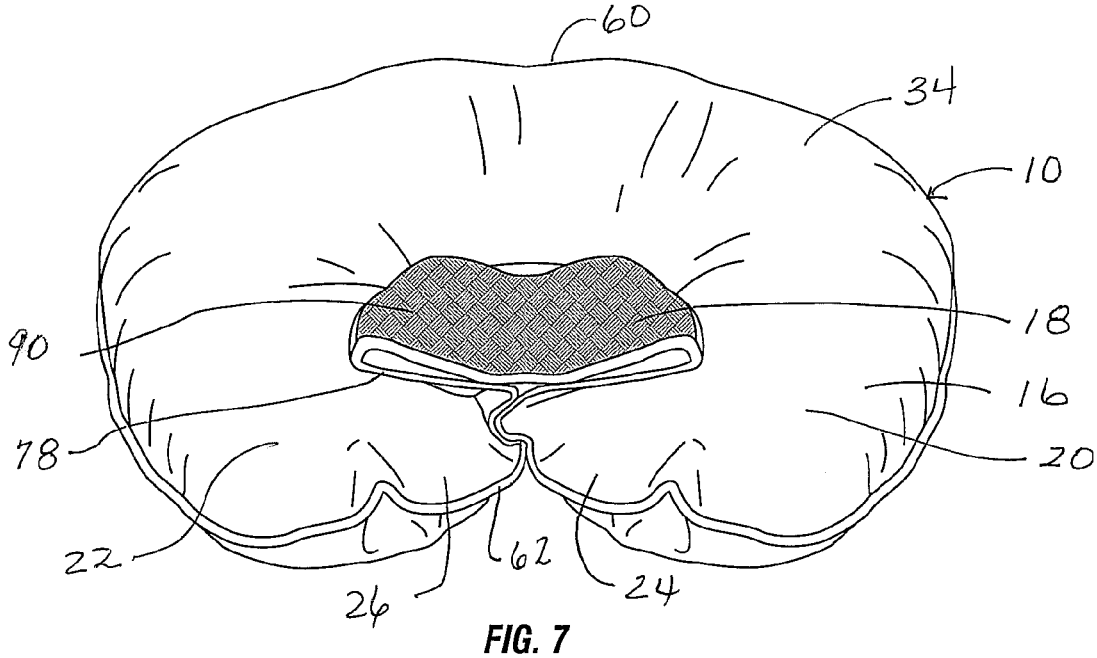
FIG. 7 is a front perspective view of the pillow in the collapsed position.
Figure 8:
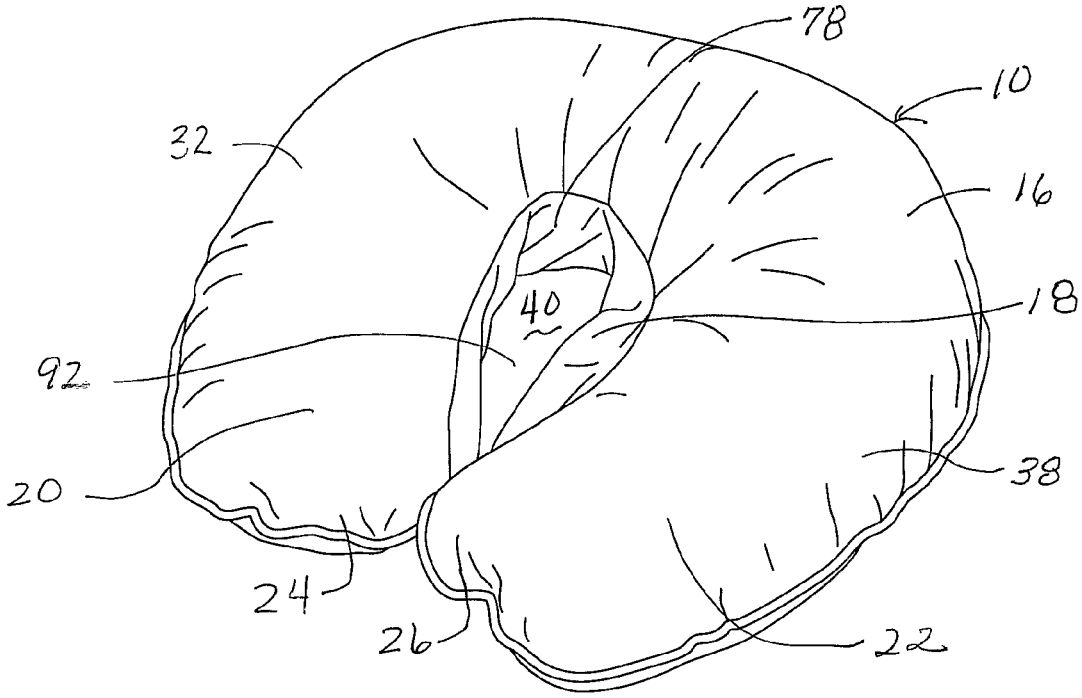
FIG. 8 is a perspective view of opposite side of the pillow in the collapsed position.

Turning now to FIGS. 6-8, a second seat position or configuration will be explained. FIG. 7 illustrates the pillow 10 of FIG. 3 flipped over so that the second surface 34 is now on top. The seat 18 is flattened or collapsed so that the seat sidewall 78 is folded and the seat bottom 70 extends over the well 40 (FIGS. 3 & 8) forming a sling or panel for supporting an infant 12 in a reclining position.

This configuration is ideal for smaller babies, such as newborn to 6 months old, who may not be long enough to sit comfortably in the seat 18 when in the first extended position described previously. Because the thickness of bolster 16 tapers downward from the back 60 to the front 62, the infant's reclining body is supported with his head and upper torso slightly higher than his legs and lower body and with his bottom nestled in the seat bottom 70 covering the well 40. Additionally, the non-slip material on the now upper (first) surface 88 of the seat bottom 70 helps keep the infant from sliding off the pillow 10.

As indicated above, the bolster 16 may be formed of water permeable fabric so that it can fill with water. In this embodiment, it will be desirable to drain and dry the pillow 10 after each use and before it is stored. Drying of the pillow 10 is facilitated by a hanger loop or handle 94, which may be attached at the back 60 of the bolster, as seen best in FIGS. 2, 4, & 5.

As described herein, the bath support pillow of the present invention provides a convenient and versatile accessory for baby's bath. It converts easily from a pillow with a sling across the top of the well for newborns and young infants to a bath seat with surrounding bolster for older babies. This accessory makes bath time more enjoyable for all concerned.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A pillow for supporting a baby in a body of water, the pillow comprising:

a compressible, shape-sustaining, bolster that is generally C-shaped defining at least a 180 degree curve, the bolster having first surface and second surfaces, and inner and outer sidewalls connecting the first and second surfaces, the inner sidewall defining a central well for receiving the baby's torso, the free ends of the bolster forming a front opening;

a collapsible seat with an open front, the seat comprising a flexible seat bottom with a perimeter including a front edge, the seat further comprising a flexible seat sidewall that extends around three sides of the seat bottom, the seat sidewall having a bottom edge, a top edge, and first and second generally vertical front edges on opposite sides of the front edge of the seat bottom, wherein the bottom edge is attached to the perimeter of the seat bottom, wherein the top edge of the seat sidewall is attached to the bolster so that the seat is positionable into a first resting position where the seat sidewall is extended in a first direction away from the second surface of the bolster and so that the extended seat sidewall is continuous with the inner sidewall of the bolster and the open front of the seat is continuous with the front opening of the well formed by the bolster, wherein the distance between the top and bottom edges of the seat sidewall defines a seat sidewall length, wherein the seat sidewall length along the first and second front edges is such that when the seat is fully extended in the first direction the front edge of the seat bottom is positioned a distance below the second surface of the bolster so that when the baby is seated in the seat the baby's legs are entirely below the bolster.

2. The pillow of claim 1 wherein the curve formed by the bolster is greater than 180 degrees.

3. The pillow of claim 1 wherein the bolster is formed by a fabric enclosure filled with a loose filler material.

4. The pillow of claim 3 wherein enclosure comprises a water permeable cover that allows water to fill the bolster when the pillow is submerged.

5. The pillow of claim 3 wherein the filling material is buoyant.

6. The pillow of claim 4 wherein the filling material is buoyant.

7. The pillow of claim 3 wherein the enclosure comprises an upper fabric panel and a lower fabric panel, the upper and lower panels joined at seams circumscribing the inner and outer sidewalls, and wherein the upper edge of the seat sidewall is attached at the seam in the inner sidewall of the bolster.

8. The pillow of claim 1 wherein the seat is positionable into a second resting position with the seat sidewall collapsed and the seat bottom extending over the well to form a sling to hold a newborn or small infant.

9. The pillow of claim 8 wherein the thickness of the back of the bolster is greater than the thickness of the free ends.

10. The pillow of claim 1 wherein the seat has a first surface and a second surface, and at least one of the first and second surfaces comprises non-slip material.

11. The pillow of claim 1 wherein bolster is buoyant.

12. The pillow of claim 1 wherein the pillow further comprises a handle for hanging the pillow when the pillow is not in use.

13. The pillow of claim 1 wherein the the seat the seat bottom is permeable to water.

14. The pillow of claim 1 wherein the seat sidewall is a solid panel of fabric forming a generally C-shaped sidewall.

* * * * *